US005555625A

United States Patent [19]

Scheminger

[11] Patent Number: 5,555,625

[45] Date of Patent: Sep. 17, 1996

[54] ROTARY CUTTER

[75] Inventor: William J. Scheminger, Olean, N.Y.

[73] Assignee: Cutco Cutlery Corporation, Olean, N.Y.

[21] Appl. No.: 553,925

[22] Filed: Nov. 6, 1995

[51] Int. Cl.[6] ..... B26B 3/00

[52] U.S. Cl. ..... 30/319; 30/307

[58] Field of Search ..... 30/306, 307, 300, 30/310, 319, 263, 292

[56] References Cited

U.S. PATENT DOCUMENTS

| | | | |
|---|---|---|---|
| Re. 32,501 | 9/1987 | Okada | 30/292 |
| 346,167 | 7/1886 | Meserole . | |
| 594,776 | 11/1897 | Burnham . | |
| 1,321,215 | 11/1919 | Kollar | 30/319 |
| 1,467,006 | 9/1923 | Murray | 30/319 |
| 1,487,226 | 3/1924 | Frahm | 30/319 |
| 3,286,349 | 11/1966 | Larson | 30/292 |
| 4,809,437 | 3/1989 | Saliaris | 30/319 |
| 5,428,898 | 7/1995 | Hawkins | 30/319 X |

*Primary Examiner*—Hwei-Siu Payer
*Attorney, Agent, or Firm*—Bean, Kauffman & Spencer

[57] ABSTRACT

A rotary cutter employs a disc blade removably mounted on a cylindrical bearing surface portion carried to upstand from adjacent one end of a handle and a swing arm movable between a retaining position in which it overlies the disc blade and a release position in which it is removed from overlying relation with the disc blade to permit removal thereof, wherein a first latch portion disposed adjacent the bearing surface portion and a second latch portion carried by the swing arm engaged to removably retain the swing arm in its retaining position.

7 Claims, 1 Drawing Sheet

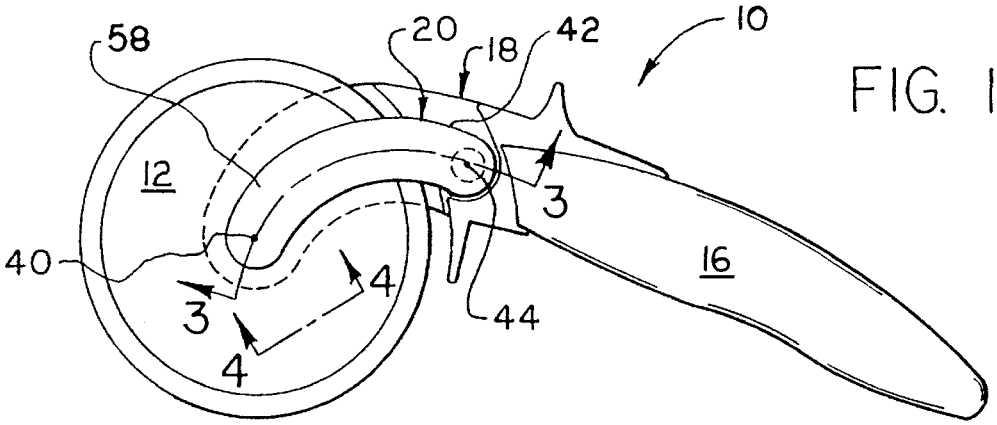
FIG. 1
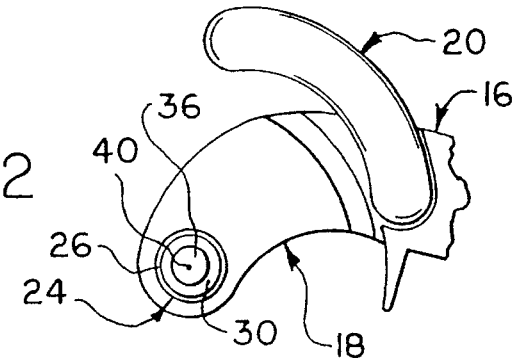
FIG. 2
FIG. 3
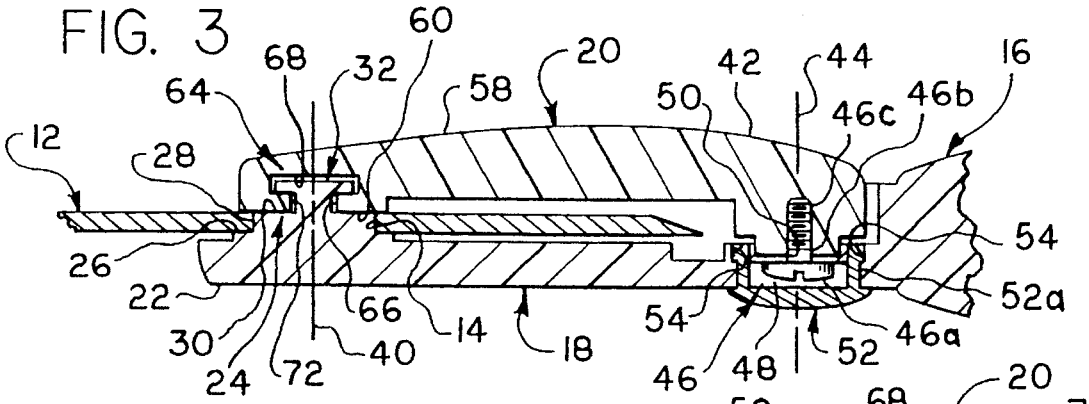
FIG. 4
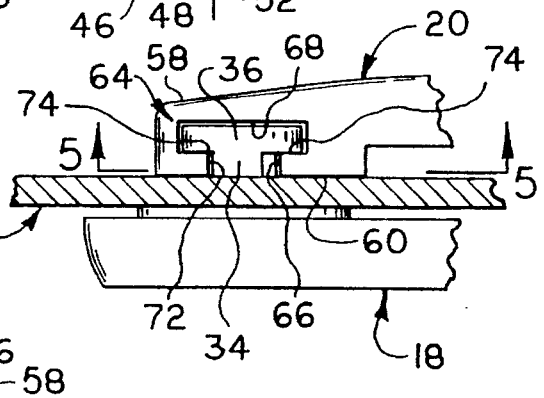
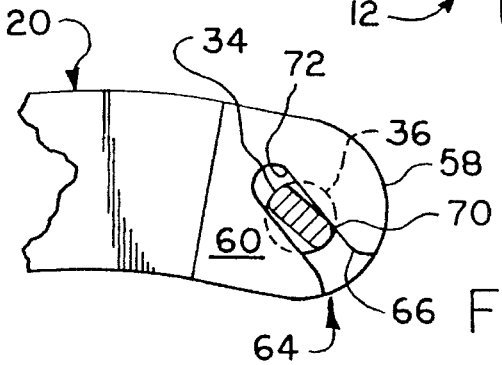
FIG. 5

ROTARY CUTTER

BACKGROUND OF THE INVENTION

Rotary cutters of the type having a disc blade removably mounted for rotation relative to a handle are known, as evidenced, for example, by U.S. Pat. Nos. 346,167; 594,776; 1,467,006; 1,487,226; 1,321,215 and U.S. Pat. No. Re. 32,501.

SUMMARY OF THE INVENTION

The present invention generally relates to rotary cutters and more particularly to a rotary cutter having removably mounted disc blade.

In accordance with a preferred form of the present invention, a handle is mold formed with an integral fixed arm, which defines a standard having a cylindrical bearing portion for removably and rotatably mounting a disc blade and serves to mount a swing arm for movement between a release position in which the swing arm is essentially removed from overlying relation with the disc blade, thereby facilitating manual removal thereof from the bearing portion and a retaining position in which the swing arm overlies the disc blade and prevents removal thereof from the bearing portion. The fixed and swing arms have integrally formed first and second latch portions, respectively, which cooperate to releasably retain the swing arm in its retaining position.

BRIEF DESCRIPTION OF THE DRAWINGS

The nature and mode of operation of the present invention will now be more fully described in the following detailed description taken with the accompanying drawings wherein:

FIG. 1 is an elevational view of a rotary cutter of the present invention;

FIG. 2 is a partial elevational view of the rotary cutter with the disc blade removed;

FIG. 3 is a sectional view taken generally along the line 3—3 in FIG. 1;

FIG. 4 is an enlarged sectional view taken generally along the line 4—4 in FIG. 1; and FIG. 5 is a sectional view taken generally along the line 5—5 in FIG. 4.

DETAILED DESCRIPTION

A rotary cutter used for example to cut pizza is generally designated as 10 in FIG. 1. Rotary cutter 10 is best shown in FIGS. 1 and 3 as generally including a metal disc blade 12 having a centrally located cylindrical mounting opening 14; a handle 16 having adjacent one end thereof a fixed arm 18; and a swing arm 20. Preferably, fixed arm 18 is formed integrally with handle 16 and this unit, together with swing arm 20, are mold formed of a plastic material.

Fixed arm 18 has a free end 22 from which upstands a standard 24, which defines in sequence an annular first bearing surface 26; a cylindrical bearing portion 28; an annular reference surface 30; and a first latch portion 32, including a post 34 upstanding from a free end of the cylindrical bearing portion and an enlarged head portion 36 fixed to the post. As best shown in FIG. 3, cylindrical bearing portion 26 is sized to be slidably, removably received within disc blade mounting opening 14, whereby to removably support disc blade 12 for rotatable movement about a first axis designated generally as 40. It will also be understood by viewing FIG. 3 that first bearing surface 26, reference surface 30 and enlarged head portion 36 having their respective axes aligned with first axis 40, and that reference surface 30 is spaced axially of first bearing surface 26 through a distance essentially equal to, but preferably slightly in excess of, the thickness of disc blade 12 in an area thereof extending annularly of mounting opening 14.

Swing arm 20 has a first end 42 pivotally mounted on fixed arm 18 adjacent its juncture with handle 16 for rotation about a second axis 44 disposed essentially parallel to first axis 40 by a fastener 46 for swinging movement between a retaining position shown in FIG. 1 and a release position shown in FIG. 2. Fastener 46 is best shown in FIG. 3 as having an enlarged head portion **46*a* loosely received within a recess 48 defined by fixed arm 18, a bearing shank portion 46*b* rotatably received with a bore opening 50 disposed in communication with recess 48 and an end portion 46*c* threadably inserted into first end 42 of swing arm 20. Preferably, the open end of recess 48 is removably closed by a cap insert 52 having legs 52*a* snap fit received within mounting openings 54 formed in fixed arm 18**.

By viewing FIGS. 3–5, it will be seen that swing arm 20 has a second or free swinging end 58 formed with a second bearing surface 60 and a second latch portion 64 in the form of a slot of generally T-shaped cross-section defined by an entrance portion 66 and an enlarged inner portion 68, which are sized and arranged to receive post 34 and enlarged head portion 36, respectively, incident to swinging movement of the swing arm into its retaining position. The engagement of second bearing surface 60 with reference surface 30 prevents disc blade 12 from being firmly clamped between the second bearing surface 60 and first bearing surface 26, such as would prevent or interfere with rotation of the disc blade relative to bearing portion 28. Moreover, it will be understood that second bearing surface 60 serves to prevent removal of disc blade 12 axially from engagement with cylindrical bearing portion 28, when swing arm 20 is in its retaining position.

In the presently preferred construction, post 34 and entrance portion 66 are arranged to assume a slight angle relative to one another when swing arm 20 is moved into its retaining position, as viewed in FIG. 5, such that only one corner 70 of the post is arranged for frictional engagement with one side wall 72 of entrance portion 66 for purposes of removably latching the swing arm in position. It is not necessary that head portion 36 be frictionally engaged with the surfaces bounding enlarged inner portion 68 for latching purposes. However, sliding engagement of head portion 36 with the pair of ledges or surfaces 74,74 bounding entrance portion 66, as shown in FIG. 4, is relied upon to prevent separating movement of second bearing surface 60 axially away from reference surface 30, such as would permit unintended axial separating movement of disc blade 12 relative to bearing portion 28.

As will be apparent from the foregoing, the first and second latch portions 32 and 64 cooperate to releasably retain swing arm 20 in its retaining position shown in FIG. 1. Constraint against swinging movement of swing arm 20 away from its retaining position may be simply that constraint offered by frictional force created by engagement of post corner 70 against side wall 72. Alternatively, the plastic material from which the fixed and swing arms are preferably formed may permit slight deformation of engaged parts, thereby to permit snap fitting together of the first and second latch portions incident to movement of the swing arm into its retaining position.

What is claimed is:

1. A rotary cutter comprising:

a disc blade having a central mounting opening;

an elongated handle having adjacent an end thereof a standard including a generally cylindrical bearing portion removably inserted within said central opening for mounting said disc blade for rotation about a first axis, a first annular bearing surface disposed adjacent one end of said cylindrical bearing portion and a first latch portion disposed adjacent an opposite end of said cylindrical bearing portion;

a swing arm having a first end pivotally mounted for swinging movement relative to said handle about a second axis disposed essentially parallel to said first axis and a second end having a second latch portion and second annular bearing surface, said swing arm being movable between a retaining position in which said swing arm is disposed to overlie said disc blade and said second bearing surface is disposed in a facing aligned relationship with said first bearing surface to prevent removal of said cylindrical bearing portion from within said central opening of said disc blade and a release position in which said swing arm is at least substantially removed from overlying relation with said disc blade to permit removal thereof from said cylindrical bearing portion and said second latch portion engages with said first latch portion for releasably retaining said swing arm in said retaining position.

2. A rotary cutter according to claim 1, wherein said second latch portion is a recess and said first latch portion is removably frictionally retained within said recess.

3. A rotary cutter according to claim 1, wherein said first latch portion includes a post upstanding from said opposite end of said cylindrical bearing portion and an enlarged head portion fixed to said post, said second latch portion is a slot of generally T-shaped cross-section having an entrance portion for slidably frictionally receiving said post incident to swinging movement of said swing arm into said retaining position and an enlarged inner portion for receiving said head portion and cooperating therewith to prevent movement of said second bearing surface away from said first bearing surface in a direction aligned with said first axis, while said swing arm is in said retaining position.

4. A rotary cutter comprising:

a disc blade having a central mounting opening;

a handle having a fixed arm extending therefrom, said fixed arm having a free end from which upstands a standard defining a first bearing surface, a cylindrical bearing portion removably insertable within said central mounting opening for mounting said disc blade for rotation about a first axis and a first latch portion; and a swing arm having a first end pivotally secured to said fixed arm adjacent a juncture thereof with said handle for swinging movement about a second axis disposed essentially parallel to said first axis and a second end having a second latch portion and a second bearing surface, said swing arm being movable from a retaining position in which said swing arm is disposed to overlie said disc blade with said second bearing surface being disposed in facing relationship with said first bearing surface and a release position in which said swing arm is at least substantially removed from overlying relation with said disc blade to permit removal thereof from said cylindrical bearing portion, said second bearing surface engaging with said disc blade to prevent removal thereof from said cylindrical bearing portion in a direction away from said first bearing surface when said swing arm is in said retaining position and said second latch portion engaging with said first latch portion to releasably retain said swing arm in said retaining position.

5. A rotary cutter according to claim 4, wherein said standard defines a reference surface facing away from said first bearing surface and spaced therefrom through a distance slightly in excess of the thickness of said disc blade, and said second bearing surface is arranged to engage with said reference surface when said swing arm is in said retaining position to prevent clamping engagement of both said first and second bearing surfaces with said disc blade.

6. A rotary cutter according to claim 5, wherein said second latch portion is a recess and said first latch portion is removably frictionally retained within said recess.

7. A rotary cutter according to claim 5, wherein said first latch portion includes a post upstanding from said cylindrical bearing portion and an enlarged head portion fixed to said post, said second latch portion is a slot of generally T-shaped cross-section having an entrance portion for slidably frictionally receiving said post incident to swinging movement of said swing arm into said retaining position and an enlarged inner portion for receiving said head portion and cooperating therewith to prevent movement of said second bearing surface away from said first bearing surface in a direction aligned with said first axis, while said swing arm is in said retaining position.

* * * * *